US007985112B2

(12) United States Patent
Vick

(10) Patent No.: US 7,985,112 B2
(45) Date of Patent: Jul. 26, 2011

(54) VEST PERSONAL FLOTATION DEVICE SAVER

(76) Inventor: George D. Vick, Charleston, SC (US)

( * ) Notice: Subject to any disclaimer, the term of this patent is extended or adjusted under 35 U.S.C. 154(b) by 256 days.

(21) Appl. No.: 12/455,781

(22) Filed: Jun. 5, 2009

(65) Prior Publication Data

US 2010/0136863 A1 Jun. 3, 2010

Related U.S. Application Data

(63) Continuation-in-part of application No. 12/315,397, filed on Dec. 3, 2008, now abandoned.

(51) Int. Cl.
*B63C 9/08* (2006.01)

(52) U.S. Cl. ..... 441/123

(58) Field of Classification Search ..... 441/80, 441/88, 106, 108, 111–119, 123, 127
See application file for complete search history.

(56) References Cited

U.S. PATENT DOCUMENTS

| | | | | |
|---|---|---|---|---|
| 1,333,763 | A | | 12/1900 | Meinecke |
| 1,468,072 | A | | 9/1923 | Millas |
| 2,374,580 | A | | 4/1945 | Brown |
| 2,405,484 | A | | 8/1946 | Bailhe |
| 3,065,476 | A | | 11/1962 | Brown |
| 3,152,343 | A | | 10/1964 | Brown |
| 3,167,794 | A | | 2/1965 | Brown |
| 3,371,363 | A | | 3/1968 | LeBlanc, Jr. |
| 3,528,116 | A | | 9/1970 | Fenar |
| 3,727,249 | A | | 4/1973 | Bonthelius |
| 3,763,972 | A | | 10/1973 | Karzmar |
| 3,988,795 | A | | 11/1976 | Robertson |
| 4,157,134 | A | | 6/1979 | Stoll |
| 4,190,918 | A | | 3/1980 | Harvell |
| 4,193,153 | A | | 3/1980 | Tyrer et al. |
| D255,966 | S | | 7/1980 | Stadel |
| 4,272,857 | A | * | 6/1981 | Oldham ..... 441/92 |
| 4,578,814 | A | | 3/1986 | Skamser |
| 4,671,393 | A | | 6/1987 | Rainey |
| D294,159 | S | | 2/1988 | Foresman |
| 4,802,233 | A | | 1/1989 | Skamser |
| 4,822,309 | A | | 4/1989 | Vandenberg |
| 4,843,662 | A | | 7/1989 | Handelman |
| 4,934,973 | A | | 6/1990 | Taylor |
| D311,808 | S | | 11/1990 | Chvilicek |
| 4,980,939 | A | | 1/1991 | Smith |
| D325,114 | S | | 4/1992 | Reed |

(Continued)

OTHER PUBLICATIONS www.pfdsavers.com.

(Continued)

*Primary Examiner* — Daniel Venne

(57) ABSTRACT

A vest personal flotation device saver includes: (a) a saver pillow portion, and two substantially mirror image saver tail portions extending from the pillow portion, with at least four substantially parallel body strap slots; (b) a central open neck; (c) an open-ended gap extending down from the open neck between the two tail portions; (d) three closable, adjacent body sides; (e) a central main chamber; and (f) a releasable closure mechanism attached to each of the body sides; wherein the personal flotation device saver has an open position and a closed position. The vest-type personal flotation device saver may include a closed tail end pocket at the end of each tail portion, a releasable saver waist strap device attached to the tail portion; and a locking mechanism adjacent the closure mechanism. This simplified abstract is not intended to limit, and should not be interpreted as limiting, the scope of the claims.

20 Claims, 14 Drawing Sheets

U.S. PATENT DOCUMENTS

| | | | | |
|---|---|---|---|---|
| 5,249,999 | A | 10/1993 | Steger | |
| 5,335,882 | A | 8/1994 | Bonacci | |
| 5,342,109 | A | 8/1994 | Berry et al. | |
| D366,383 | S | 1/1996 | Briegleb | |
| D366,800 | S | 2/1996 | Moore, Jr. | |
| 5,551,108 | A | 9/1996 | Butler, III | |
| 5,566,410 | A | 10/1996 | Schaechter | |
| 5,702,153 | A | 12/1997 | Pliska | |
| 5,775,967 | A | 7/1998 | Lacoursiere et al. | |
| 5,785,568 | A | 7/1998 | Lake | |
| D413,733 | S | 9/1999 | Edmonds | |
| 6,018,143 | A | 1/2000 | Check | |
| 6,089,936 | A | 7/2000 | Hoffman | |
| 6,152,527 | A | 11/2000 | McDowell | |
| 6,281,477 | B1 | 8/2001 | Forrester et al. | |
| 6,328,618 | B1 * | 12/2001 | Fleischli | 441/106 |
| 6,537,119 | B2 * | 3/2003 | Deslauriers | 441/106 |
| 6,568,976 | B2 | 5/2003 | Anderson | |
| 6,820,938 | B2 | 11/2004 | Barrett | |
| 7,034,254 | B2 | 4/2006 | Grabowski et al. | |
| 7,052,211 | B1 | 5/2006 | Curry | |
| 7,059,924 | B2 | 6/2006 | Farmer et al. | |
| 7,255,621 | B2 | 8/2007 | Deslauriers | |
| 7,266,852 | B2 | 9/2007 | Davis | |
| D601,844 | S | 10/2009 | Miller | |
| 2007/0135005 | A1 | 6/2007 | Whitney | |
| 2007/0164014 | A1 | 7/2007 | Saadoun | |
| 2007/0287343 | A1 | 12/2007 | Deville et al. | |
| 2008/0090476 | A1 | 4/2008 | Hamburg | |
| 2008/0311808 | A1 | 12/2008 | Oneill et al. | |

OTHER PUBLICATIONS

US Coast Guard "Think Safe: Choose the Right Personal Flotation Device", Item 000-BO-006 PPPC/850000/08-08, pp. 1-16, USA.

http://www.uscgboating.org/safety/life_jacket_wear_wearing_your_life_jacket.aspx, 3 pages.

* cited by examiner

VEST PERSONAL FLOTATION DEVICE SAVER

CROSS REFERENCE TO RELATED DOCUMENT

This is a continuation-in-part of U.S. patent application Ser. No. 12/315,397, filed Dec. 3, 2008 now abandoned and entitled "Vest Personal Flotation Device Saver".

BACKGROUND OF THE INVENTION

1. Technical Field

The present invention relates to a vest-type personal flotation device saver that can be used in combination with a serviceable or non-serviceable Type I or II personal flotation device by a swimmer in the water in a potential emergency situation for use as a personal flotation device.

2. Background Information

An estimated 17 million old personal flotation devices (called "PFDs" herein) are discarded every year in the United States. The US Coast Guard and most states require that old, non-serviceable PFDs be taken out of service. "Non-serviceable" means that the PFD must not be used for service as a life saving device, since it may fail. Often, the outer fabric of the PFD has deteriorated and therefore may fail to hold intact the life saving fill material inside it. PFDs are designed to keep a person afloat during an emergency. Torn, worn, rotten, and deteriorated PFD fabrics can put the user's life in peril in an emergency situation.

Secondly, old PFDs cause disposal problems. In a landfill, they are generally not biodegradable and can last for hundreds of years. Old PFDs that are channeled into garbage disposal systems are often burned along with other garbage, which can release hazardous fumes into the environment. If they are not properly disposed of, old PFDs are a hazard to wildlife. A device that protects any PFD, old or new, preserves it against the elements, such as wind and rain, and sun, and thus helps to protect the environment from the adverse effects of old discarded units.

The combination of the personal flotation device saver (hereinafter "PFD saver") of the present invention and a universal life preserver (PFD) inserted in it is itself a life preserver that is capable of meeting US Coast Guard requirements. Normally, if a life preserver is placed within a hand-sewn cover, for example, it is considered non-accessible and therefore would not qualify for use as a life preserver. In a home sewn cover, the PFD would be discounted as ineffective by the US Coast Guard and other state law enforcement agencies. The PFD saver combination of the present invention actually becomes a comparable or better product in comparison with the PFD that has been inserted in it. For instance, a vest-type PFD saver of the present invention with a Type II PFD inserted in it becomes a dual purpose Type II and Type IV PFD. Meanwhile, the enclosed PFD is protected, giving it an extended life span. It is believed that PFD savers according to the present invention extend the life of enclosed PFDs indefinitely, and help to stop damage being done to the environment caused by discarding old, non-usable products.

The present PFD saver is intended to help protect the environment against discarded "non-serviceable" PFDs and to keep new PFDs in new condition for a longer perid. The PFD savers will be replaced over time instead of replacing the PFDs themselves. U.S. patent application Ser. No. 12/315,396, Vick, filed Dec. 3, 2008, entitled "Cushion Personal Flotation Device Saver" issued as U.S. Pat. No. 7,819,715 B2 on Oct. 26, 2010.

A vest-type PFD saver of the present invention with a Type I or II PFD inserted in it is available for immediate use as a Type IV PFD by a person in distress in the water. A second option is to open the conversion connector device of the invention and use the PFD saver/PFD combination as a Type II PFD. A third option is to open the PFD saver of the present invention, remove the PFD, and use the PFD on its own in a conventional manner. Meanwhile, the enclosed PFD is protected, giving it an extended lifespan. The PFD saver of the present invention is beneficial to boaters as it will save them from having to purchase a separate Type IV PFD, and helps to stop damage to the environment caused by discarding old, non-usable products.

BRIEF SUMMARY OF THE INVENTION

The present invention is a vest-type personal flotation device ("PFD") saver, which comprises: (a) a main body comprising: (1) a saver pillow portion, (2) two substantially mirror image saver tail portions extending from a same side of the saver pillow portion, and (3) a central open neck, (4) a gap extending down from the open neck between the two saver tail portions, (5) a closed tail end pocket at the end of each saver tail portion, and (6) three closable sides of the main body; (b) a releasable closure mechanism on each of the three closable sides of the main body; (c) a releasable saver waist strap device, a portion of which is attached to the tail portion; and (d) a locking mechanism on the main body adjacent the closure mechanism. The main body has an open position in which the closure mechanism is open, and a closed position in which the closure mechanism is closed. The PFD saver is preferably in combination with a PFD. The present PFD saver may further include a conversion system including: (1) a releasable conversion connector device attached to a closed end of each of the saver tail portions; (2) at least two conversion grab straps having opposite ends attached to the main body; and (3) a conversion flotation liner that comprises buoyant conversion flotation liner sections.

The present invention also includes a slotted vest-type PFD saver, which includes: (a) a saver pillow portion, and two substantially mirror image saver tail portions extending from a same side of the saver pillow portion, with at least four body strap slots on a top section of the personal flotation device saver; (b) a central open neck extending through the personal flotation device saver; (c) an open-ended gap extending down from the open neck between the two tail portions; (d) three closable body sides, one of the body sides extending substantially perpendicular to the other two substantially parallel ones of the body sides; (e) a central main chamber within the personal flotation device saver that is accessible through the closable body sides; and (f) a releasable closure mechanism attached to each of the three closable body sides; wherein the personal flotation device saver has an open position in which the closure mechanisms are open, and a closed position in which the closure mechanisms are closed. The closure mechanisms are preferably hook and loop strips. For use, the PFD saver is loaded with a vest-type PFD.

Advantages of the vest-type PFD savers of the present invention include the following:

1) They protect new or used but serviceable PFDs from the effects of weather and the ultraviolet rays of the sun, and from wear and tear.
2) They allow old, weathered, or worn (non-serviceable) PFDs to be utilized in lieu of being burned in incinerators or discarded in landfills or inappropriate locations, where they can be a hazard to wildlife. This helps to protect the environment. As the PFD saver of the present invention fails over time, it can be replaced and the like-new PFD inside it gets a second life, then a third, and so forth.

3) The PFD saver/PFD combination can be thrown to a person in the water in a potential emergency situation for use as a Type IV personal flotation device. Secondly, the conversion connector device can be opened for use as a Type II PFD. Thirdly, the interior Type I or II PFD can be removed from the PFD saver and the interior PFD is then used as a universal PFD to help a person in distress stay afloat in the water.

4) The conversion flotation liner in the PFD saver, if any, can be fabricated from used foam fill material from old PFDs, so long as the recycled fill material is still sufficiently buoyant to meet requirements. This helps to conserve resources and protect the environment.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
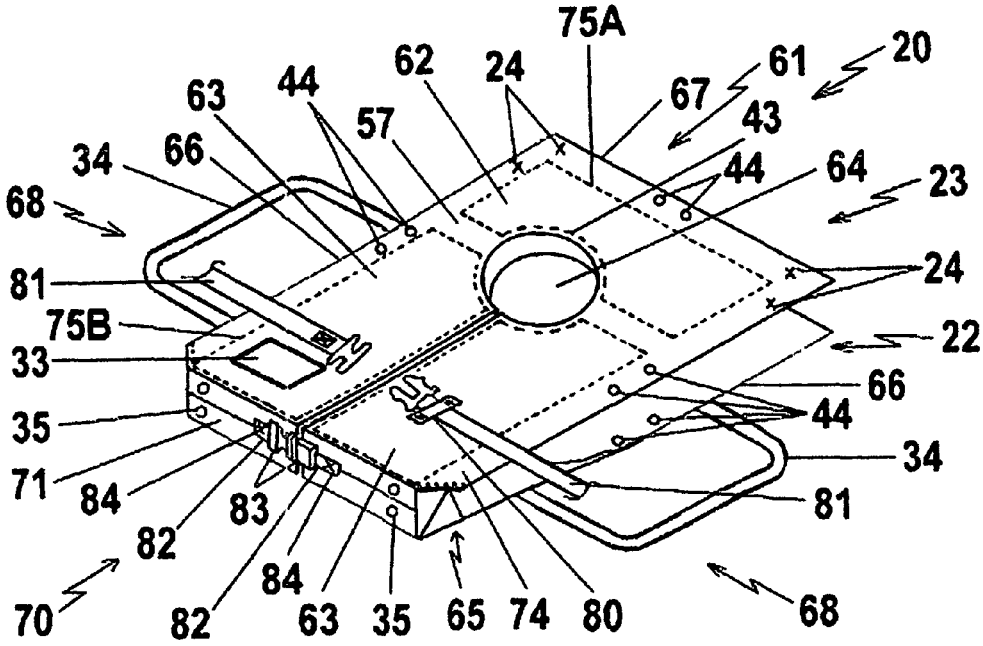
FIG. 1 is a perspective view of a vest-type PFD saver according to the present invention, shown in an open position.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, a PFD saver embodying the principles and concepts of the present invention and generally designated by the reference numeral 20 will now be described.

Figure 2:
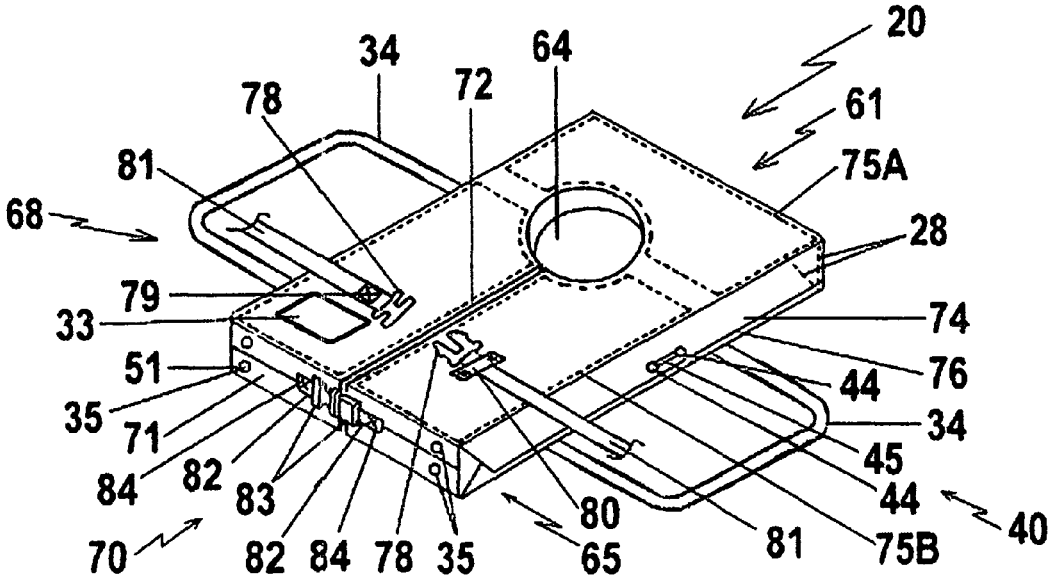
FIG. 2 is a perspective view of the vest-type PFD saver according to FIG. 1, shown ready for use.
Figure 7:
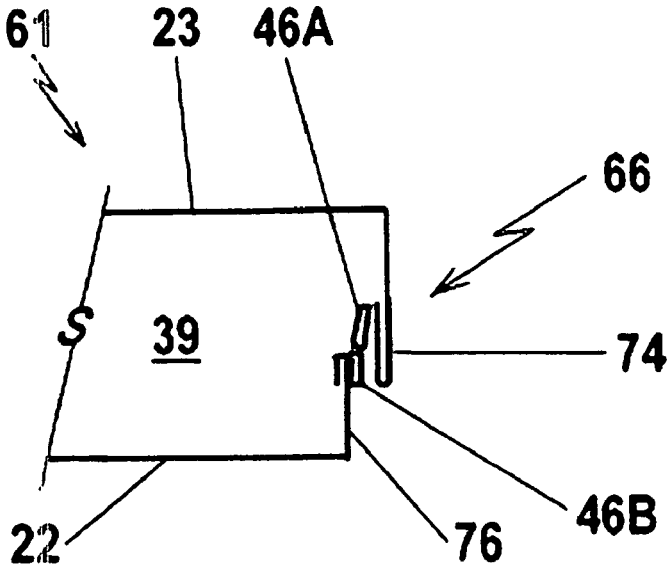
FIG. 7 is a cross-sectional view of the vest-type PFD saver according to FIG. 6, taken across line 7-7.
Figure 8:
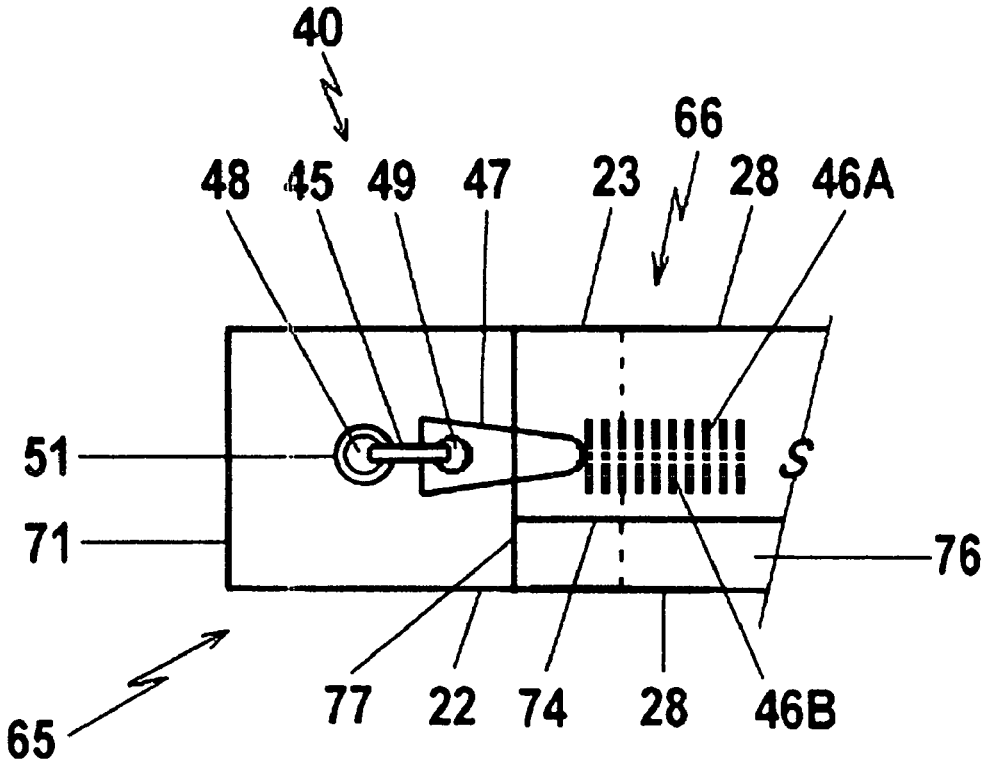
FIG. 8 is an expanded view of a zipper pull area of a vest-type PFD saver according to the present invention, shown in a closed, locked position.

Turning first to FIGS. 1 and 2, a vest-type personal flotation device saver 20 for holding a PFD comprises: (a) a main body 61 comprising: (1) a saver pillow portion 62, (2) two substantially mirror image saver tail portions 63 extending from the pillow portion, and (3) a central open neck 64, (4) a gap 72 extending down from the open neck between two closed sides of the tail portions 63, (5) a closed tail end pocket 65 at the end of each saver tail portion 63, and (6) three closable, adjacent sides of the main body 61; (b) a releasable closure mechanism 17 on each of the three closable, adjacent sides of the main body 61, as seen in FIGS. 4, 7, and 8; (c) a releasable saver waist strap device 68, a portion of which is attached to the saver tail portion 63; and (d) a locking mechanism 40, preferably comprising locking strips 45 and a set of locking holes 44 on each of the three body sides 66, 67 of the PFD saver, as illustrated in FIG. 2. The main body 61 has an open position for loading a Type II PFD 21 (or Type I PFD) in which the closure mechanism 17 is open, as seen in FIGS. 1 and 3, and a closed position for use in which the closure mechanism 17 is closed, as seen in FIG. 2.

Figure 5:
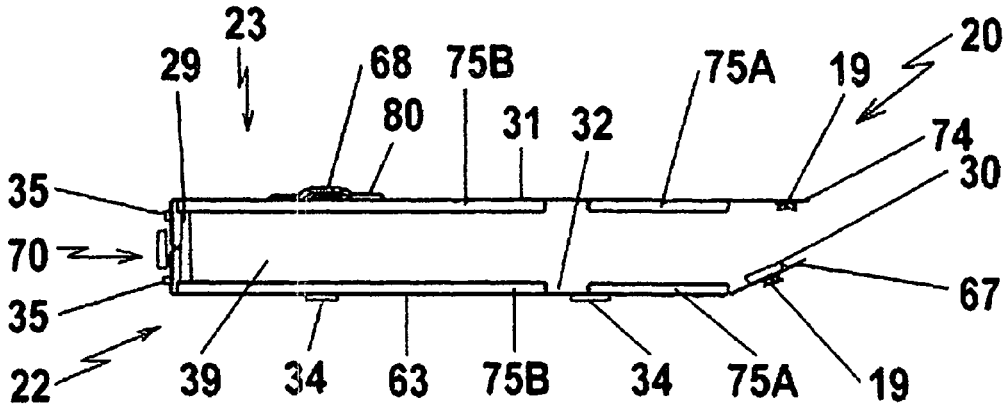
FIG. 5 is a cross-sectional view of the vest-type PFD saver according to FIG. 3, taken across line 5-5.

The PFD saver 20 preferably further includes: (e) a releasable conversion connector device 70 attached to a closed end 71 of each of the saver tail portions 63; (f) at least two conversion grab straps 34 attached to the main body 61; and/or (g) a conversion flotation liner 75 comprising top and bottom pillow and tail conversion flotation liner sections 75A, 75B, as seen in FIG. 5. Also, the PFD saver 20 preferably further includes: at least two hook and loop tabs 24 at the top corners of the PFD saver, or at least one short seam 28 stitched at each of the two side corners as seen in FIG. 2, to form two neat boxed corners on the PFD saver.

When the conversion connector device 70 is attached, the two saver tail portions 63 are connected to one another. When the conversion connector device 70 is open, the through gap 72 can be widened by the user so that the yoke-like PFD saver 20/PFD 21 combination can be draped around the user's neck for possible or actual use. The releasable saver waist strap encircles the user's waist and the saver tail portions 63 when the PFD saver 20 is in the closed position and in use. By "releasable" herein is meant that the waist strap device 68 and conversion connector device 70 can each be repeatedly opened and closed (reattached) as desired.

Figure 3:
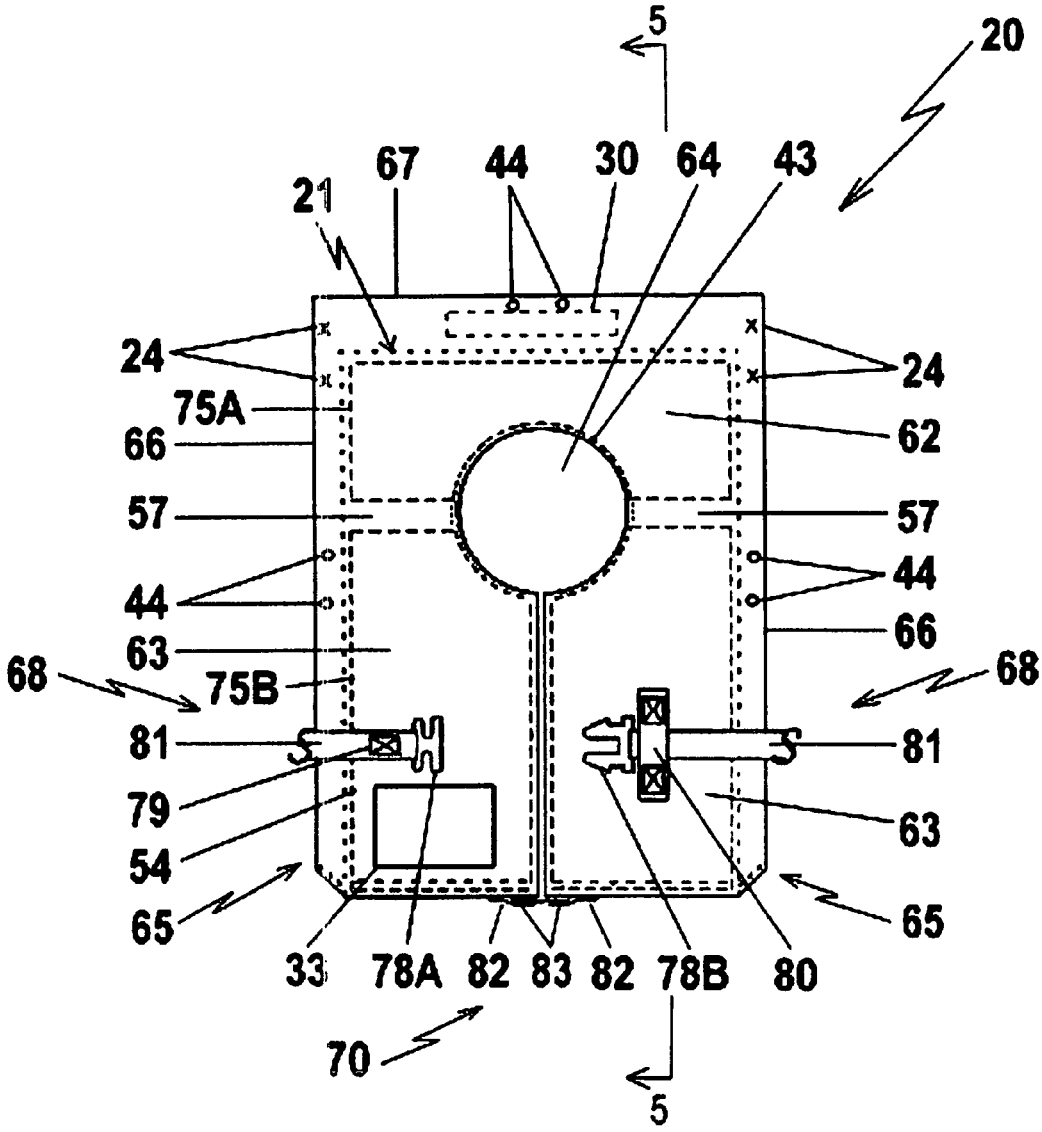
FIG. 3 is a top plan view of a vest-type PFD saver according to the present invention, shown in an open position with a PFD inside.
Figure 4:
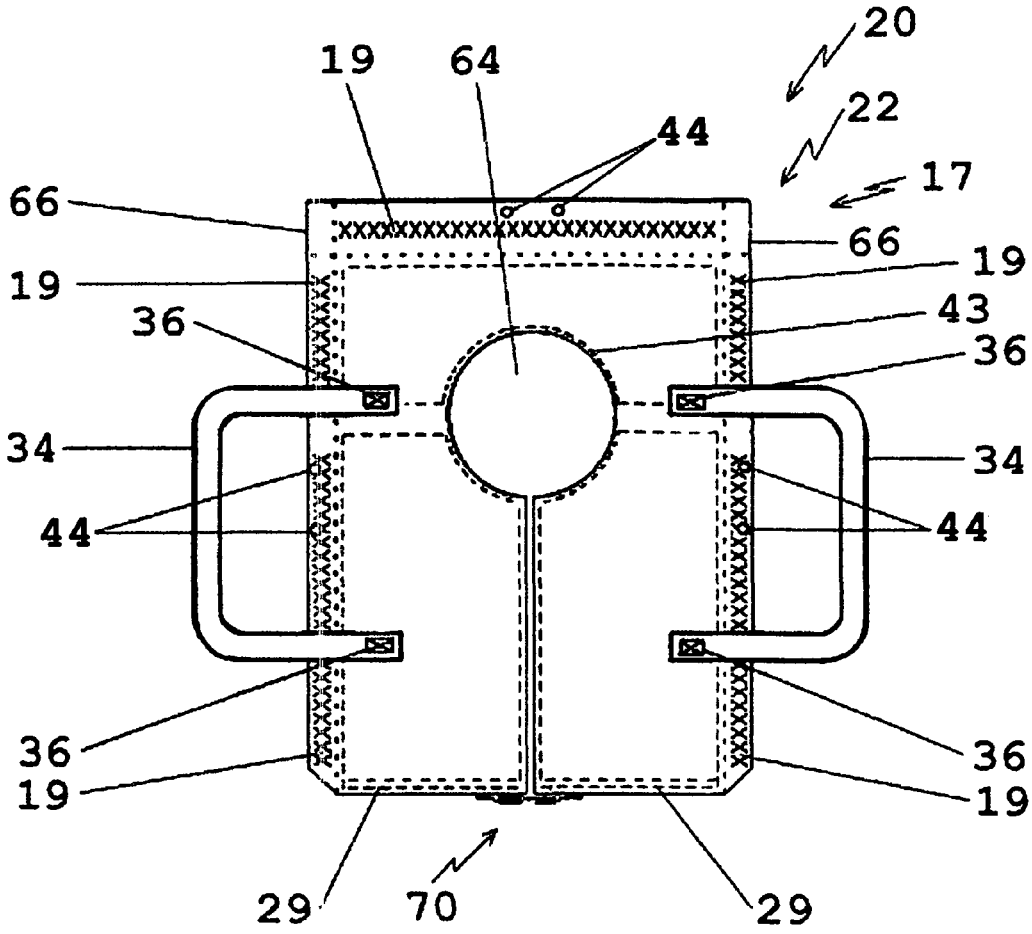
FIG. 4 is a bottom plan view of a vest-type PFD saver according to the present invention, shown in an open position.

The vest-type PFD saver 20 is ready for use once a Type II personal flotation device ("PFD") 21 has been inserted into it, as seen in outline in FIG. 3. The vest-type PFD saver 20 protects the Type II PFD 21 within it. The vest-type PFD saver/Type II PFD combination is available for immediate use by a person in distress as a Type IV PFD when the conversion connector device 70 is in the normally closed position. The combination is sufficiently buoyant to support the weight of the person in the water. It is also readily available for use as a Type II PFD by opening conversion buckles 83.

The three closable, adjacent sides of the main body 61 are the two closable, opposite longitudinal sides 66 of the main body 61, and a closable open pillow end 67 at the top of the saver pillow portion 62 opposite the closed tail end pockets 65. By "adjacent sides" herein is meant that the end of each longitudinal side 66 contacts an opposite end of the closable pillow end 67, preferably forming right angles. The opposite ends of each longitudinal side 66 connect to a closed end 71 of a different one of the tail portions 63, preferably also forming approximate right angles, as seen in FIG. 2. The four outer corners of the PFD saver 20, which is somewhat flexible, may be rounded.

The main body 61 of a preferred PFD saver 20 as seen in FIGS. 1 and 2 is made from two generally equal and rectangular pieces of a long lasting, UV (ultraviolet rays) resistant, outdoor, substantially flexible and breathable, sturdy material that has been approved by the US Coast Guard. Such materials may include nylon, polyester, canvas, denim, cotton, etc. The main body 61 is preferably fluorescent orange or red, or as desired by the end user. The two, single layer pieces form the bottom and top sections 22, 23 of the main body 61. They are preferably substantially the same size as one another. The main body may instead be fabricated from a single piece of material with no seam on the bottom 71.

The main body 61 has an open position for loading the PFD 21 in the PFD saver 20, and a closed position for use. The main body 61 is in the closed position once the closure mechanism 17 has been closed, which is done after the PFD is inserted in the PFD saver.

Continuing with FIGS. 1 and 2, the saver pillow portion 62 is at one end of the assembled main body 61 of the PFD saver 20, and the two mirror image saver tail portions 63 extend down from either side of the pillow portion 62. When the Type I or II PFD 21 is in the PFD saver 20, the combination resembles the PFD. When the PFD 21 is in the PFD saver 20, flexible creases 57 demarcate the saver pillow portion 62 from the two saver tail portions 63 on each side of the central open neck 64. The saver gap 72 extends down from the open neck 64 between the saver tail portions 63. The gap 72, or split, divides the two saver tail portions 63 from one another. The tail ends 71 of the two saver tail portions 63 are permanently closed. The inside sides, which are on either side of the gap 72 between the saver tail portions 63, are also closed, as by a sewn seam. The outside, longitudinal edges of the main body form the two closable, opposite longitudinal sides 66. The PFD saver/PFD combination is ready for use once the PFD has been inserted in the chamber 39 formed by the bottom and top sections 22, 23, the bottom, closed tail ends 71, the closed inside tail sides alongside the tail portion gap 72, and the longitudinal sides 66 and the pillow end 67 once they have been sealed.

A Type I PFD can be used in place of a Type II PFD 21, if desired. A Type I PFD has the same general appearance as the Type II PFD 21 shown in FIG. 3. A Type I PFD is ordinarily intended for use in the ocean, so it has more fill than a thinner Type II PFD. The Type II PFD is frequently used in coastal areas, lakes, and the like. The thicker Type I PFDs are often the life jackets worn by passengers during ocean-going cruise safety drills. It is understood that some adjustments in size and shape may be necessary.

The tail end pocket 65 at the outer end of each saver tail portion 63 supports the PFD tail sections 54 when the PFD 21 is in the PFD saver 20, as seen in FIGS. 2 and 3. It is believed that the tail end pockets 65 speed and ease insertion of the PFD into the PFD saver 20. The closed tail end pockets 65 also hold the PFD in place while the closure mechanism 17, such as the hook and loops strips 19 or zipper portions 46, are closed.

As seen in FIGS. 1 and 2, each closed tail end pocket 65 can be formed by closing the lower corner of each longitudinal side 66 like a hospital corner of a bed sheet and sewing or gluing it in place. A top flap 74 is formed by folding down the edge of the material of the two longitudinal sides of the top section 23. The top flap 74 overlies a bottom flap 76, which is formed by folding up the edge of the bottom section 22 along the two longitudinal sides 66 of the PFD saver 20.

A light weight strip 29 as seen in FIGS. 3, 4, and 5 is optionally included in each tail end pocket 65 for adding weight to that end of the PFD saver/PFD combination. In addition to bringing the weight of the combination up to a required government standard, if any, it is believed that the small amount of additional weight added by the weight strips 29 makes the PFD saver/PFD combination easier to throw accurately to someone in distress in the water. An accurate toss can mean the difference between life and death in some circumstances. The weight strip 29 is preferably straight and made of recycled plastic. Each weight strip 29 preferably weighs between about two and about four ounces. It is preferably attached to the bottom in each tail end pocket 65 of each saver tail portion 63 within the chamber 39, as seen in FIGS. 4 and 5.

As seen in FIGS. 1, 2, 5, and 6, the main body 61 includes a number of drain holes 35, preferably two at the outer corner of the closed tail end 71 of each saver tail portion 63, so that water, if any, can drain out from inside the main body 61. Each drain hole 35 is preferably surrounded by a rust-resistant grommet 51.

The releasable closure mechanism 17 is preferably a number of hook and loop strips 19, as illustrated in FIG. 4. Preferably, the backs of first hook and loop strips 19A, or first parts of another closure mechanism, are attached to the inside surface 32 of the top section 23 along the particular side edge. The backs of corresponding hook and loop strips 19B, or second, mating parts of another closure mechanism, are attached to an outside surface 31 of the bottom section 22 along the particular side edge, as seen in FIG. 5. The hook and loop strips 19 of the closure mechanism 17 are removably attached to one another when the PFD saver 20 is in the closed position, and are not mated when the PFD saver 20 is in the open position shown in FIG. 4. Preferably, about a 1½ inch gap is included in the hook and loop strips 19 along the side closures at the neckline to allow flexibility and comfort while wearing a vest-type PFD saver 20/Type II PFD 21 combination.

The edges of the longitudinal and top sides 66, 67 of the bottom section 22 are folded up (along the sides of the PFD in the saver) to form three bottom flaps 76, and the edges of the longitudinal sides 66 and the pillow end side 67 of the top section 23 fold down to form three top flaps 74 (see FIGS. 1 and 2). At least two, most preferably three, top flaps 74 of the PFD saver are closed over the corresponding bottom flaps 76 of the PFD saver once the PFD is inside using the hook and loop strips. The pillow side 67 of the PFD saver 20 is preferably dressed with at least two hook and loop tabs 24 at the top corners of the saver. When they are attached, the hook and loop tabs 24 form neat boxed corners on the PFD saver 20. An alternative to the hook and loop tab is a short seam 28 that is stitched at each of the two side corners to form two neat boxed corners on the PFD saver, as seen in FIG. 2.

To close the PFD saver 20 once the PFD 21 has been inserted in it, the user closes the top flap 74 as seen in FIG. 2 over the bottom flap 76 of the bottom section 22, or vice versa, so that the hook and loop strips 19 on the flaps 74, 76 align on each of the three body sides 66, 67. In the saver closed position, all three body sides 66, 67 are closed. To open the PFD saver 20, the user simply pulls up on the top flap 74, or down on the bottom flap 76 if it overlaps the top flap, on each of the three body sides 66, 67. Once the PFD saver 20 is open, the PFD 21 can be removed from the PFD saver 20.

The PFD saver 20 includes a locking mechanism 40 for locking the PFD saver once a non-serviceable PFD has been installed in it. The preferred locking mechanism 40 comprises a set of locking holes 44 on each of the three body sides 66, 67 of the PFD saver, as illustrated in FIGS. 1 and 2, and a locking strip 45 through each set of the locking holes 44. The locking strip 45 is passed through one locking hole 44 in the set and then the other locking hole 44 in the set and is then sealed (see FIGS. 2 and 9). Thus, three locking strips 45 lock the three saver body sides 66, 67.

Figure 9:
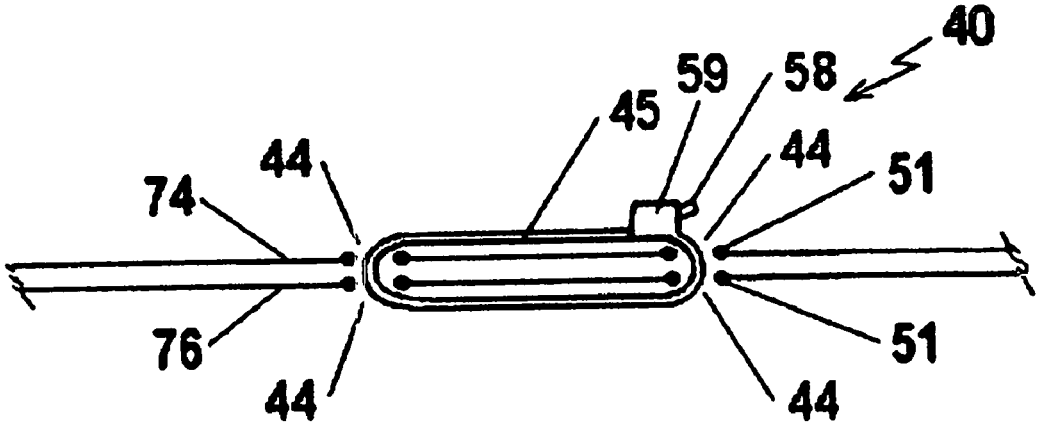
FIG. 9 is a schematic view of a locked locking mechanism of a vest-type PFD saver according to the present invention.

If they have been cut, one or more of the locking strips 45 of the locking mechanism 40 can easily be replaced by removing a replacement locking strip from a storage pocket 30 on the PFD saver 20, and inserting it through the two sets of locking holes 44, as illustrated in FIG. 9, while the PFD saver 20 is in the closed position. The replacement locking strip 45 is then sealed. Where the locking strip 45 is a preferred tie wrap, it is sealed by inserting the end 58 of the tie wrap through the locking loop 59 on the tie wrap and pulling it (see FIG. 9).

Figure 6:
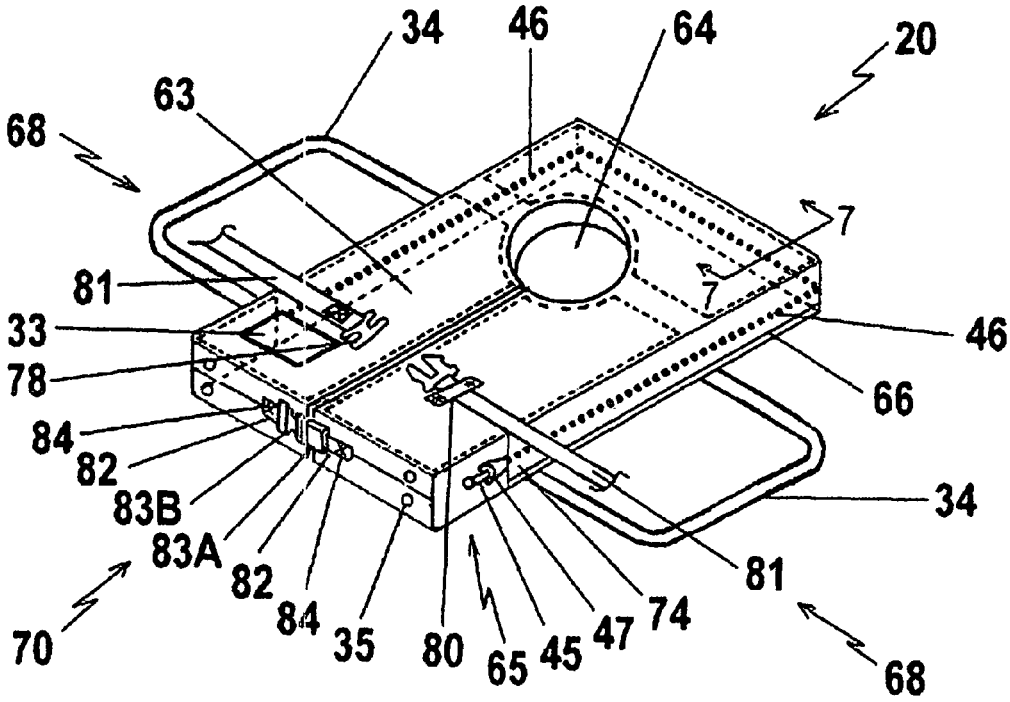
FIG. 6 is a perspective view of a vest-type PFD saver according to the present invention, shown with a closed zipper.

Turning now to FIGS. 6 through 8, a zipper closure mechanism can be used instead of hook and loop strips to close the three sides 66, 67 of the main body 61. As seen in FIGS. 7 and 8, a first portion 46A of a zipper 46, such as an upholstery zipper, is attached to the edge of the top section 23 of the main body 61. A corresponding, second portion 46B of the zipper 46 is attached to the bottom section 22 of the main body 61. The PFD saver 20 has an open position with the zipper 46 open, and a closed position with the two portions of the zipper 46 zipped together. One zipper 46 preferably extends around the three body sides 66, 67, although one zipper on each side (total of three zippers) could be employed.

The top flap 74 preferably extends over and protects the zipper as seen in FIGS. 6-8. The top flap 74 can be formed by folding back a strip, preferably about one inch, of the material of the top section 23 (see FIG. 7).

Alternatively, the top flap 74 can be formed by sewing the zipper portion 46A to the inside surface of a top (or bottom) side strip of the same material as the top section 23 along the midline of the side strip on its inside surface 32. One longitudinal edge of the top side strip is sewn to a side edge of the top section 23. The opposite, longitudinal edge of the top side strip forms the top flap 74. The top flap 74 overlaps the bottom flap 76. One longitudinal edge of the bottom flap 76 is sewn to a side edge of the bottom section 22. The rear edge of the other portion of the zipper 46B is sewn to the opposite, longitudinal edge of the bottom flap 76, as seen in FIG. 8. The two zipper portions 46A, 46B are then in a position to be zipped open or closed, as desired. The ends 77 of the top side strip and the bottom flap 76 adjacent the zipper pull when it is closed overlap a top end of a tail end pocket 65, as seen in FIG. 8. The zipper pull locking hole(s) 48 are in the end portion of the tail end pocket 65. Each locking hole 48 is preferably surrounded by a rust-resistant grommet 51.

If desired, the zipper 46 can be closed and locked by inserting a locking strip 45 (preferably nylon) through a hole 49 in a zipper pull 47 of the zipper 46 and through at least one and preferably two of the zipper pull locking holes 48, as seen in FIG. 8. The locking strip 45 is then sealed. This is advisable when the PFD is non-serviceable.

If desired, the sealed plastic locking strip 45 can be cut in order to open the PFD saver 20. Authorities, such as US Coast Guard personnel, may find it necessary to do so in order to inspect the PFD within the PFD saver 20. Hook and loop locking holes 44 can be used when the PFD saver 20 includes the hook and loop strips. Each locking hole 44, 48 in the main body 61 is preferably surrounded by a grommet 51, as seen in FIG. 8.

A cut locking strip 45 is easily replaced by removing a replacement locking strip from the storage pocket 30, inserting it through the locking holes 44, 48, and sealing the replacement locking strip 45. The storage pocket 30 is ordinarily inside and adjacent the area of the zipper 46 or hook and loop strips 19, where it is protected and can easily be accessed (see FIGS. 3 and 5). It can alternatively be located within the tail end pocket 65. The storage pocket 30 accommodates spare locking strips when the locking mechanism 40 of the PFD saver 20 includes a locking strip 45 (see FIG. 8). Where the closure mechanism is a zipper 46, the locking strip 45 is inserted through the zipper pull locking holes 48 and the hole 49 in the zipper pull 47 of the zipped up zipper 46, and then sealed. The locking strip 45 is preferably a tie wrap.

The PFD saver 20 preferably includes a conversion flotation liner 75, which most preferably includes two substantially planar pieces of conversion flotation liner 75A in each saver pillow portion 62 and two substantially planar conversion flotation liner pieces 75B in each saver tail portion 63, as seen in FIG. 5 (for a total of six liner pieces in each combination). In the PFD saver of FIG. 5, one conversion flotation liner piece 75A rests on top of the PFD pillow section 53 in the PFD saver 20, and one similarly sized pillow conversion flotation liner piece 75A lies under the PFD pillow section 53. Similarly, one tail conversion flotation liner piece 75B rests on top of each PFD tail section 54 in the PFD saver 20, and one similarly sized tail conversion flotation liner piece 75B lies under each PFD tail section 54 in the PFD saver 20. The conversion flotation liner pieces 75 are preferably made of closed cell foam material that has been recycled from non-serviceable PFDs. The pillow conversion flotation liner piece 75A is approximately the length and width of the saver pillow portion 62 and the tail conversion flotation liner piece 75B is preferably the length and width of a saver tail portion 63. The conversion flotation liner 75 provides buoyancy and cushioning for comfort, and prevents the straps/buckles of the PFD from being felt by the wearer of the PFD saver/PFD combination.

The closed cell foam conversion flotation liner 75 pieces add a minimum of 4.5 pounds of inherent buoyancy to the vest-type PFD saver/PFD combination, so that the combination qualifies as a Type IV PFD, or a Type I or II PFD where a Type II PFD has been inserted. If the closed cell foam conversion flotation liner pieces 75 are not included in the vest-type PFD saver 20, it is believed that the combination still qualifies as a Type II PFD, or a Type I PFD where a Type I or Type II PFD is inserted.

A patch 33 bearing a logos or seal may be attached to or printed on an outside surface 31 of the main body 61, as seen in FIGS. 1-3 and 6. The patch 33 preferably bears a US Coast Guard seal of approval and is sewn or adhered to, or printed directly on, a lower corner, or the center, of the top section 23 of the PFD saver 20. The PFD saver 20 can be stuffed with other suitable types of PFD fill, or with another type of suitable, lightweight, floatable, water-resistant fill material, as desired. Fill material must meet US Coast Guard specifications.

The patch 33 preferably shows the approval number as well as the type of device the PFD saver 20 becomes under which conditions, the location of which may vary. The patch 33 preferably includes a warning that advises the end user of the requirement to permanently lock the PFD saver 20 when a non-serviceable PFD is contained in it.

Referring to FIGS. 1-3 and 6, the vest-type PFD saver 20 further includes a releasable waist strap device 68, which includes a waist strap 81. The waist strap device includes corresponding waist strap buckle portions 78A, 78B affixed to opposite ends of the saver waist strap 81. The waist strap device 68 is releasably closed by sliding one waist strap buckle portion 78B into the other waist strap buckle portion 78A. The waist strap 81 encircles the saver tail portions 63. One end portion of the saver waist strap 81 is preferably affixed to the top section 23 on one tail portion 63 at 79. The opposite end portion of the saver waist strap 81 slides under a waist strap loop 80 that is affixed to the top section 23 of the other tail portion 63. The waist strap loop 80 holds the waist strap 81 in place and allows for adjustment. In use, the PFD saver 20/PFD 21 combination can be draped around the user's neck, with the saver pillow portion 62 behind the user's head and neck and the saver tail portions resting on the user's chest area. The saver waist strap 81 can be tightened by pulling on the opposite end portion with its waist strap buckle portion 78B. The saver waist strap 81 is sized to meet US Coast Guard requirements. The waist strap buckle 78 of the waist strap device 68 is preferably a snap or clasp buckle in front of the PFD saver.

The Type IV-type conversion system of the PFD saver 20 preferably comprises: (1) the releasable conversion connector device 70, which is attached to a closed end of each of the saver tail portions, (2) at least two conversion grab straps 34 attached to the main body; and (3) the conversion flotation liner 75, which preferably comprises top and bottom pillow conversion flotation liner sections and top and bottom tail conversion flotation liner sections. As seen in FIGS. 1, 2, and 6, the conversion connector device 70 includes two short conversion connector straps 82A, 82B, and a corresponding conversion connector strap buckle portion 83A, 83B. The conversion connector strap buckle portions 83 are each affixed to an end of the two saver conversion connector straps 82. The conversion connector device 70 is releasably closed by sliding one conversion connector strap buckle portion 83B into the other conversion connector strap buckle portion 83A. The conversion connector device 70 joins the saver tail portions 63 to one another when it is in the closed position. An opposite end portion of each short conversion connector strap 82 is preferably affixed to the closed end 71 of one tail portion 63 at a conversion strap attachment site 84, as seen in FIGS. 1, 2, and 6. The conversion connector strap buckle 83 of the conversion connector device 70 is preferably a snap or clasp buckle.

Where the PFD saver 20 houses a Type II PFD 21, the combination PFD saver/Type II PFD is immediately available as a Type IV PFD when the PFD saver is closed and the two conversion connector strap buckle portions 83 of the saver conversion connector device 70 are snapped together in a normally closed position. To permit a change from a Type IV PFD to a Type II PFD, so that it is readily available as a Type II PFD, the conversion connector buckle 83 of the conversion connector device 70 is unsnapped so that it is in an open position. The PFD saver 20 alternatively houses a Type II PFD 21 that is available only as a Type II PFD, as long as the PFD saver 20 remains unlocked and the Type II PFD inside is serviceable. Where the PFD is serviceable, the conversion connector device 70, conversion flotation liner 75, and conversion grab straps 34 of the Type IV-type PFD system can be eliminated. A locking mechanism 40, such as the locking strip 45 shown in FIG. 8, is required when a non-serviceable PFD is installed in the PFD saver 20. When a non-serviceable PFD is installed inside the PFD saver 20, the locking mechanism 40, such as the locking strip 45 shown in FIG. 8, is locked.

The PFD saver 20 preferably includes two equal length conversion grab straps 34 affixed to the bottom section 22 on opposite longitudinal sides 66 of the main body 61. The opposite ends of each mirror image conversion grab strap 34 are affixed to the opposite longitudinal sides 66 of the bottom section 22 at grab strap attachment sites 36. The conversion grab strap 34 is preferably made of cotton, polyester, and/or nylon material and conforms to all the requirements of the US Coast Guard. If the combination PFD saver 20/PFD 21 will be used as a Type II PFD only, conversion grab straps 34 are not needed and can be omitted.

To use the PFD saver 20/PFD 21 combination, the user opens the conversion connector strap buckle 83 and the waist strap buckle 78 and places the combination around the user's shoulders with the neck opening 64 around the user's neck. The user then fastens the waist strap around the waist. This is usage as a Type II PFD.

Alternatively, when the conversion connector device 70 is closed, the user can place one arm through each conversion grab strap 34 of the PFD saver 20/PFD combination, and hug the central main body 61 against the user's chest. Either the top section 23 or the bottom section 22 of the main body 61 can be pressed against the user's chest. If desired, the user can wrap each arm around the main body 61 and lean on the PFD saver/PFD combination as the user floats in the ocean or other body of water. This is Type IV PFD-type usage.

When the PFD saver 20 is not in use, the conversion grab straps 34 hang loosely on either side of the main body 61. Either conversion grab strap 34 can be used to pick up the PFD saver/PFD combination on a boat or on a dock, for example, and throw it in the water. The conversion grab strap 34 is also useful for grabbing the floating PFD saver/PFD combination and pulling it to the user when the user is in the water.

In a preferred embodiment of the PFD saver 20, stitching material at a 45 degree hem is heavy outdoor rated upholstery thread, seams 28 remain simple with a single seam along bottom and interior sections of the vest-type PFD saver 20, and all edges are folded back and hemmed.

In a preferred PFD saver 20, a weight strip 29 made from recycled plastic material is included to increase overall weight, depending on the added weight provided by the closed cell foam conversion flotation liner pieces 75. If a zipper 46 is used, there will be at least two seams 28 around the vest-type PFD saver 20 (see FIG. 8). As seen in FIG. 8, the zipper pull 47 can be locked closed through zipper pull locking holes 48 with grommets 51 in the tail end pocket 65. The top flap 74 covers the zipper 46. The preferred PFD saver 20 also includes drain holes 35 for drainage. Certain main body materials may require grommets around the drain holes 35 to prevent tearing. Finally, the preferred PFD saver 20 includes the snap conversion connector strap buckle 83, which is kept in a normally closed position for use of the combination as a Type IV device.

In summary, the combination PFD/vest-type PFD saver includes the PFD saver, which comprises: (a) a main body 61 comprising: (1) a saver pillow portion 62, (2) two substantially mirror image saver tail portions 63 extending from the saver pillow portion 62, and (3) a central open neck 64, (4) a gap 72 extending down from the open neck 64 between the tail portions 63, and (5) three closable body sides 66, 67 of the main body 61; (b) a releasable closure mechanism 17 on each of the three closable body sides 66, 67; (c) a releasable saver waist strap device 68, a portion of which is attached to a saver tail portion 63; (d) a conversion system comprising (1) a releasable conversion connector device 70 attached to a closed end 71 of each of the saver tail portions 63, (2) at least two (preferably two) conversion grab straps 34 attached to the main body 61, and (3) a conversion flotation liner 75 that comprises floatable conversion flotation liner sections 75A, 75B; and (e) a locking mechanism 40 on the main body 61 adjacent the closure mechanism 17. The main body 61 has an open position in which the closure mechanism 17 is open, and a closed position in which the closure mechanism 17 is closed. The PFD is not folded within the PFD saver 20, and is easy to insert in the PFD saver and remove from the PFD saver. The PFD need not fold or include a hinge in order to fit in the PFD saver. Neither the PFD saver 20 nor the PFD have arm holes. The PFD saver 20 is lightweight, durable, and easy to store when it is not in use.

The PFD saver 20/PFD combination with the Type II PFD 21 becomes a Type IV PFD ready for immediate use when the conversion connector device 70 is in the normally closed position. The PFD saver 20 is not merely a carrying bag for a PFD. The PFD saver 20/PFD combination when a Type II PFD 21 is installed becomes a Type II PFD readily available for use as a Type II PFD by unsnapping the buckle of the conversion connector device 70. The PFD saver/PFD combination when a Type I PFD is installed becomes a Type IV PFD ready for immediate use when the conversion connector device 70 is in the normally closed position. The PFD saver/PFD combination when a Type I PFD is installed becomes a Type I PFD and is readily available for use as a Type I PFD by unsnapping the buckle of the conversion connector device 70. The PFD saver/PFD combination with a Type II PFD is installed becomes a Type II PFD ready for immediate use when there is no conversion system. The PFD saver/PFD combination when a Type I PFD is installed becomes a Type I PFD ready for immediate use when there is no conversion system.

Figure 10:
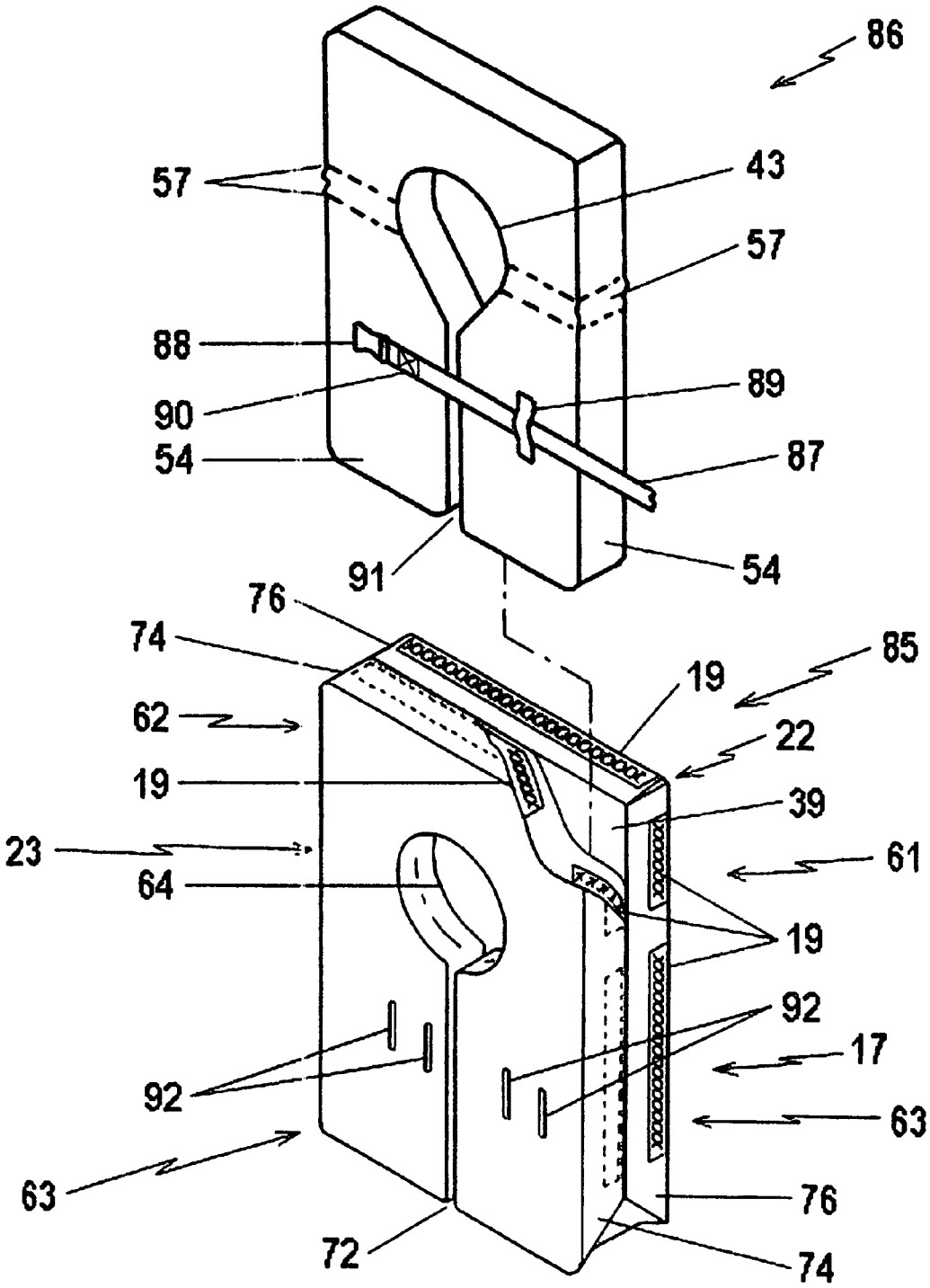
FIG. 10 is a perspective view of a PFD and a slotted vest-type PFD saver according to the present invention, shown in a partially open position.
Figure 11:
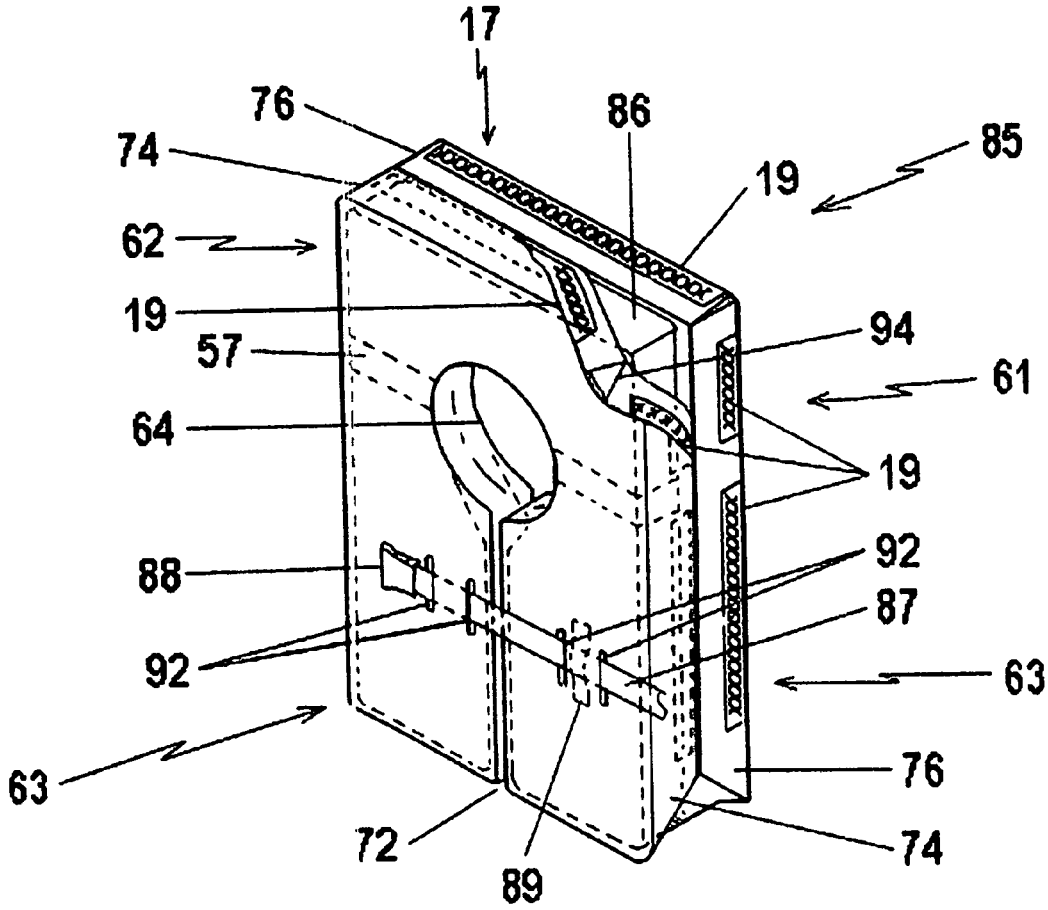
FIG. 11 is a perspective view of a slotted vest-type PFD saver according to the present invention, shown in a partially open position with a PFD inside.
Figure 12:
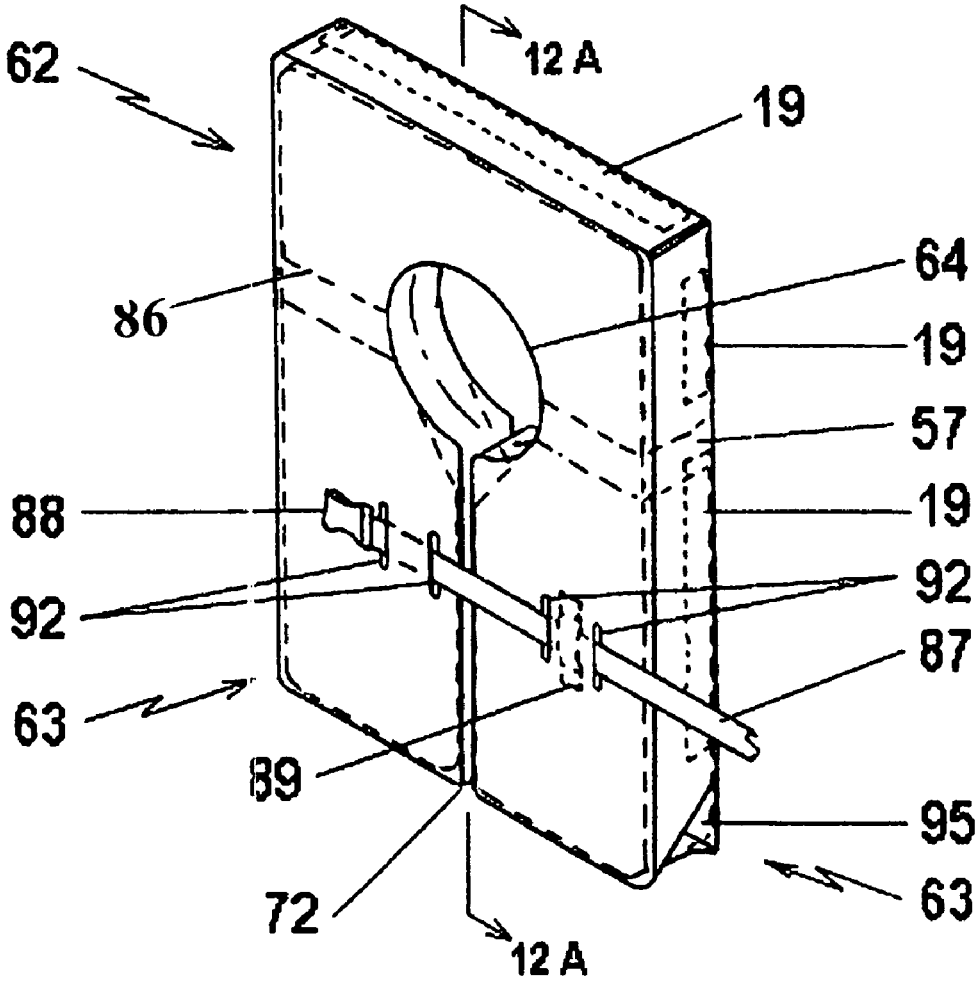
FIG. 12 is a perspective view of a slotted vest-type PFD saver according to the present invention, shown in a closed position with a PFD inside.

In another preferred, slotted vest-type PFD saver 85 seen in FIGS. 10 through 22, the PFD saver 85 includes at least four slots 92 for supporting the body strap 87 of a universal Type I or II PFD. A Type II PFD 86 is shown in FIGS. 10, 11, and 12 within the central main chamber 39 of the PFD 86, with the body strap 87 of the PFD 86 being threaded through the body strap slots 92. When the slotted vest-type PFD saver 85 is in use, it encloses a vest-type PFD 86.

Figure 12A:
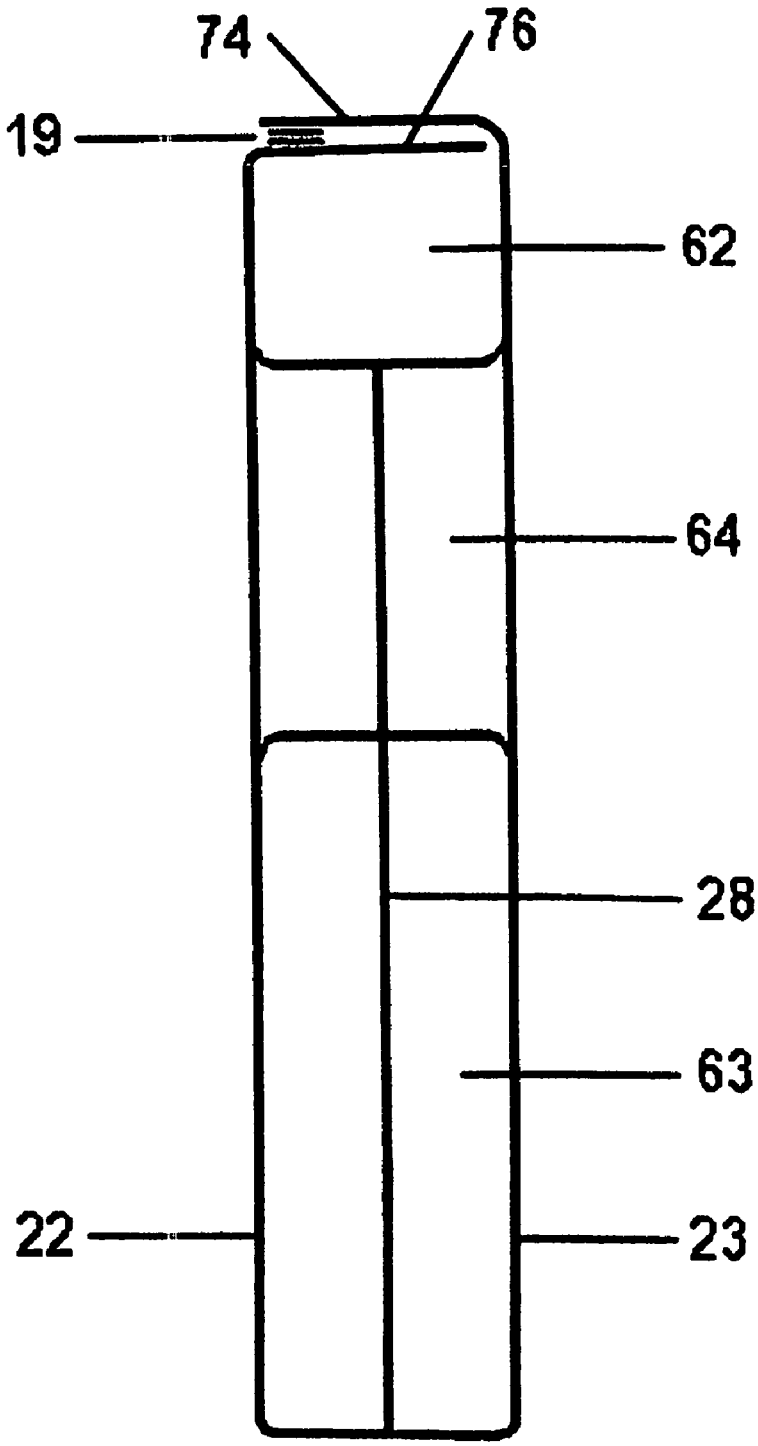
FIG. 12A is a cross-sectional view of the slotted vest-type PFD saver according to FIG. 12, taken at line 12A-12A.
Figure 13:
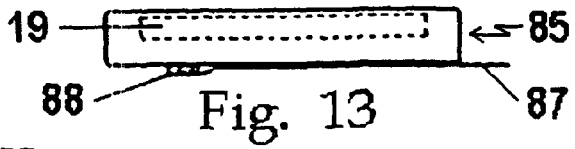
FIG. 13 is a rear end elevation view of the slotted vest-type PFD saver according to FIG. 12.
Figure 14:
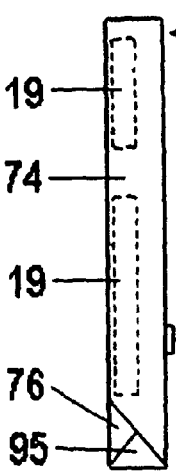
FIG. 14 is a right side elevation view of the slotted vest-type PFD saver according to FIG. 12.
Figure 15:
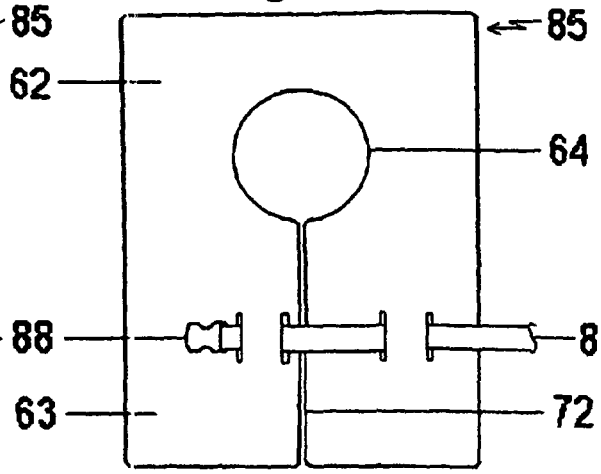
FIG. 15 is a top plan view of the slotted vest-type PFD saver according to FIG. 12.
Figure 16:
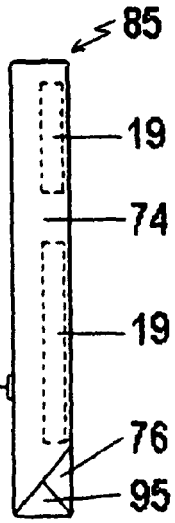
FIG. 16 is a left side elevation view of the slotted vest-type PFD saver according to FIG. 12.

Referring to FIGS. 10 through 22, the slotted, vest-type PFD saver 85 herein includes: (a) the saver pillow portion 62 of the main body 61, and the two substantially mirror image saver tail portions 63 extending from the same side (the base) of the pillow portion 62, with at least four of the body strap slots 92 on the top section 23 of the PFD saver 85; (b) the central open neck 64 at the base of the pillow portion 62; (c) the open-ended gap 72 extending down from the open neck 64 between the two tail portions 63; (d) the three closable body sides 66, 67, one body side 67 extending substantially perpendicular to the other two substantially parallel body sides 66; (e) the central main chamber 39 within the PFD saver 85 that is accessible through the closable body sides 66, 67; and (f) a releasable closure mechanism 17 attached to each of the three closable body sides 66, 67. The PFD saver 85 has an open position in which the closure mechanisms 17 are open for loading a Type I or II PFD into the PFD saver, as seen in FIGS. 10 and 11, and a closed position in which the closure mechanisms 17 are closed, as seen in FIG. 12. The inside faces of the tail portions 63 along the gap 72 are closed, preferably with a seam 28, as seen in FIG. 12A. Thus, the sides of each saver tail portion 63 are closed, except for the outside, longitudinal side 66 of the tail portion, which is openable. As in the adult-size PFD saver described herein: (1) at least one end of each closable body side 66, 67 is connected to an end of another one of the body sides 66, 67; (2) the pillow portion 62 is also bordered at the top by the pillow end side 67 of the PFD saver, and along its side edges by an upper portion of the opposite longitudinal sides 66 of the PFD saver; (3) the closure mechanisms 17 are preferably releasable hook and loop strips on each of the three closable body sides 66, 67; and (4) preferably, the body strap slots 92 number two on each saver tail portion 63, and are substantially parallel to one another and to the longitudinal sides 66 of the PFD saver 85. The closable body sides 66, 67 are the two, opposite longitudinal sides 66, which are substantially parallel to one another and equal in length, and the pillow end side 67 between, and perpendicular to, the longitudinal sides 66.

Figure 20:
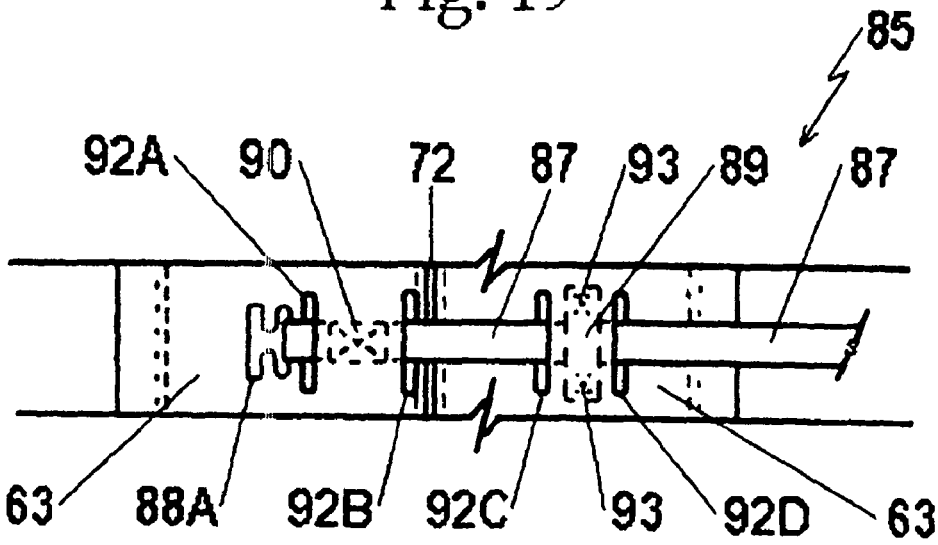
FIG. 20 is an enlarged top plan view of a slotted portion of the slotted vest-type PFD saver according to FIG. 19.

As seen in FIG. 20, the PFD body strap 87 is securely attached to the front of the PFD at body strap attachment point 90. The body strap attachment point 90 is close to the end of the body strap 87, where the body strap is attached to the buckle portion 88A. This is preferably the sole point of attachment of the PFD body strap to the PFD. The body strap attachment point 90 is approximately midway up the right PFD tail portion 63, adjacent the gap 72 between the two tail portions 63. The body strap 87 also passes under a body strap loop 89. The PFD body strap loop 89 is attached to the PFD 86 at its two opposite loop ends 93 to the front of the left tail section 54 adjacent the gap 72 between the two PFD tail sections 54. The body strap slots 92C, D are preferably parallel to the PFD body strap loop 89 below them. The left tail portion ordinarily covers the left side of the wearer's chest when it is in use, and the right tail portion ordinarily extends over the right side of the wearer's chest.

The spaced apart body strap slots 92 are slits through the saver fabric and are preferably each substantially the same size and parallel to one another. The slots 92 for the body strap are preferably reinforced along their edges and at each end. One set of two body strap slots 92A, B is on the front of one tail portion 63 next to the gap 72 between the tail portions, and a second set of two body strap slots 92C, D is on the front of the other tail portion 63 closer to the hook and loop side of the PFD saver.

Figure 19:
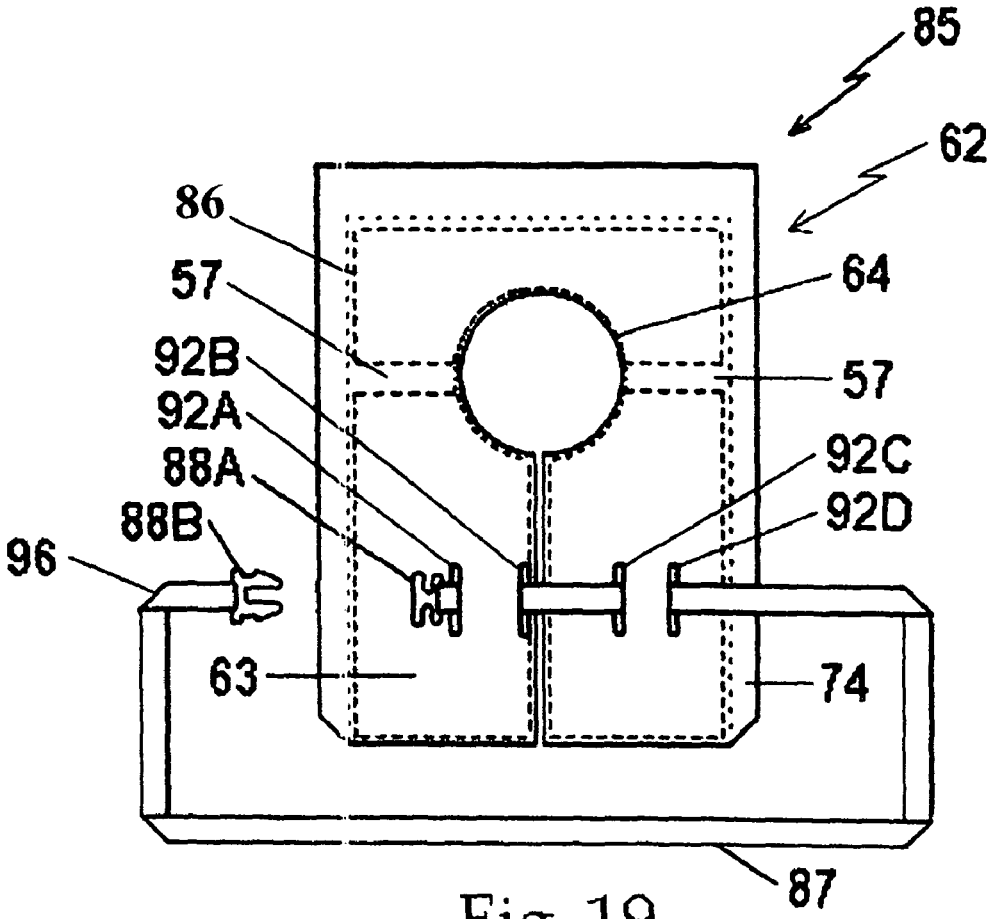
FIG. 19 is a top plan view of a slotted vest-type PFD saver according to the present invention, shown in a fully open position with a PFD inside.

Once the main body 61 of the PFD 86 is inserted in the main chamber of the PFD saver 85 but before closing the three closable body sides 66, 67 of the PFD saver, the buckle portion 88A is inserted through the first body strap slot 92A, which is on the right tail portion 63 on the front of the PFD saver 85 (see FIG. 20). As seen in FIG. 19, the buckle portion 88A is not clipped to its corresponding buckle portion 88B on the opposite end of the body strap 87 when it is being inserted though the first body strap slot 92A. As seen in the combination PFD/PFD saver shown in FIG. 20, the first body strap slot 92A is located on the PFD 86 so that when the PFD is snugly in place in the PFD saver 85, the first slot 92A is between the buckle portion 88A and the body strap attachment point 90.

The first body strap slot 92A supports the buckle portion end of the body strap 87 when the PFD saver is in use. The second body strap slot 92B is located on the PFD 86 so that when the PFD is snugly in place in the PFD saver, the second body strap slot 92B, which is also on the right tail portion 63, is between the body strap attachment point 90 and the edge of the tail portion next to the gap 72 between the tail portions. Once the buckle portion 88A is inserted through the first slot 92A, the opposite, free end 96 of the body strap 87 is inserted up through the next, second slot 92B and pulled relatively taut.

The opposite end 96 of the PFD body strap 87 then passes over the gap 72 and is laced down through the third slot 92C, which is in the other PFD tail portion 63. In the PFD/PFD saver combination, the body strap 87 extends through the body strap loop 89 of the PFD 86 under the PFD saver, and up through the fourth and last body strap slot 92D. The corresponding buckle portion 88B at the opposite end of the PFD body strap 87 can be left on the body strap during the lacing process, or it can be removed during the lacing process and then replaced at the opposite end 96 of the body strap 87 once the body strap has been laced through the slots 92 and the body strap loop 89. When the PFD 86 is snugly in place in the PFD saver 85, the body strap loop 89 lies between the third and fourth slots 92C, D under the PFD saver top section 23. The strategic placement of the body strap slots 92 permits the PFD body strap 87 to fit tautly along the front of the PFD. The remaining, loose portion of the body strap 87, as seen in FIG. 19, is placed around the back of the user's torso once the open neck hole 64 of the saver/PFD has been placed around the user's neck. Once the body strap 87 is in place, the user clips the buckle portions 88A, B together in front of the PFD saver/PFD combination and pulls the free end of the strap relatively taut.

The corresponding hook and loop strips 19 along the three adjacent sides of the PFD saver are then attached to one another, which closes the PFD saver 85 over the PFD 86. At least two, most preferably three, top flaps 74 of the PFD saver are closed over the corresponding bottom flaps 76 of the PFD saver once the PFD is inside using the hook and loop strips 19. The top flap 74 is preferably closed down over the bottom flap 76 along the three adjacent PFD sides, as seen in FIGS. 10, 12, 14, and 16, forming two envelope-like corners 95 along the longitudinal sides 66 at the two lower corners of the PFD saver. The hook and loop strips 19 on the top flaps 74, which are attached on the inside surface of the top section 23 of the PFD saver 85, attach to corresponding hook and loop strips 19 attached on the outside surface of the bottom section 22 of the PFD saver. The backs of the hook and loop strips 19 are preferably adhered to the PFD saver material by sewing, gluing, or other conventional methods.

As seen in FIG. 11, the upper two corners in the pillow portion 62 at the front of the slotted vest-type PFD saver 85 optionally each include a pleat 94. The corner pleats 94 inside the two upper saver corners form tight corners when the PFD saver is closed and in use and facilitate rapid closure of the PFD saver.

Figure 17:
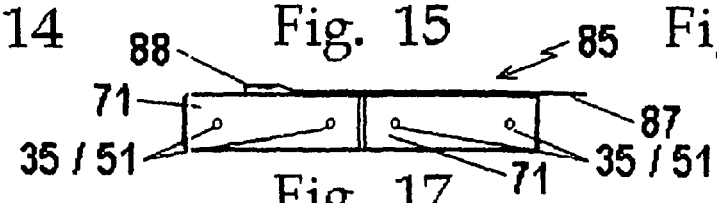
FIG. 17 is a front end elevation view of the slotted vest-type PFD saver according to FIG. 12.
Figure 18:
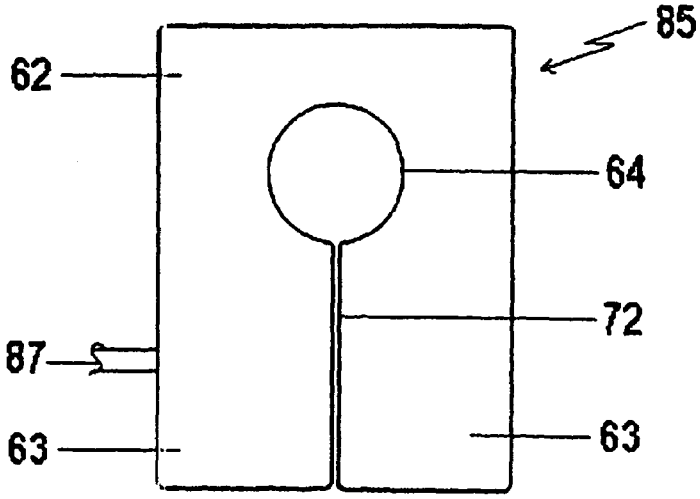
FIG. 18 is a bottom plan view of the slotted vest-type PFD saver according to FIG. 12.

The slotted vest-type PFD saver 85 preferably also includes about two or three drain holes 35 at the closed tail end 71 of each tail portion 63 of the PFD saver 85, as seen in FIG. 17. The drain holes 35 permit water, if any, to drain out from inside the main body 61. Each drain hole 35 is preferably surrounded by a rust-resistant grommet 51.

Figure 21:
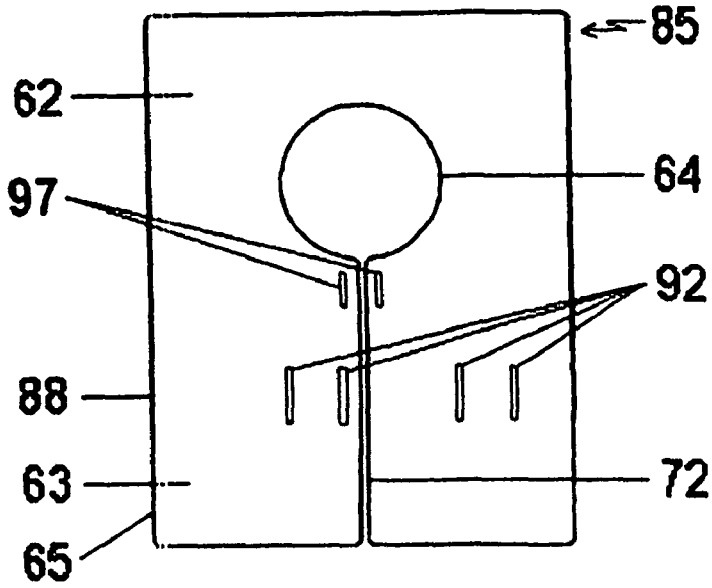
FIG. 21 is a top plan view of a child-size slotted vest-type PFD saver according to the present invention.
Figure 22:
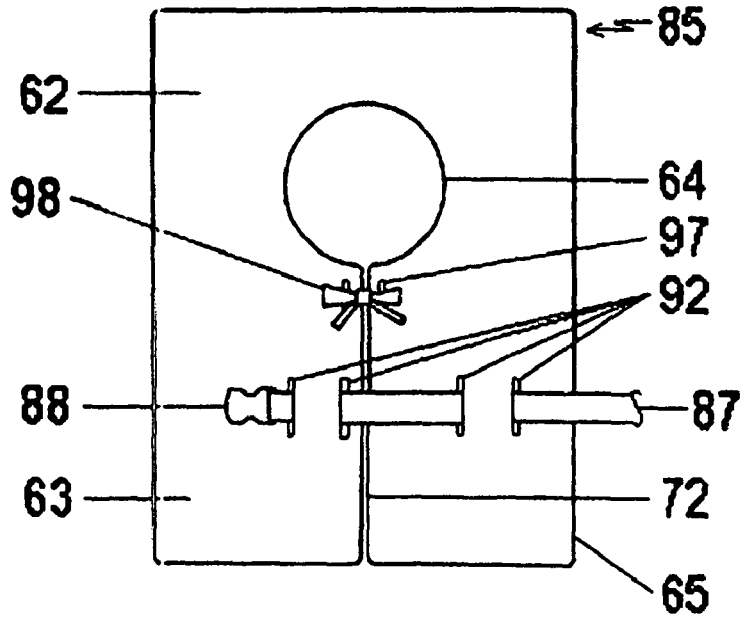
FIG. 22 is a top plan view of the child-size slotted vest-type PFD saver according to FIG. 21, shown with a PFD inside.

Turning to FIGS. 21 and 22, a child-size slotted vest-type PFD saver 85 accommodates a child-size Type II PFD, such as a PFD for a toddler child who weighs between about 30 and 50 pounds, and a child's PFD for a child weighing between about 50 and about 90 pounds. The child-size PFD saver 85 includes two parallel, same sized neck tie strap slots 97, in addition to the four body strap slots 92 described above. The neck tie strap slots 97 straddle, and are substantially parallel to, the gap 72. The tie strap slots 97 are located under the open neck hole 64, as seen in FIG. 21. Once a child's PFD is inserted in the PFD saver 85, each neck tie strap 98 of the child's PFD is laced through a corresponding tie strap slots 97 as seen in FIG. 22. Once the PFD/PFD saver combination is placed on the child, the PFD neck tie straps 98 can be tied to one another.

Figure 23:
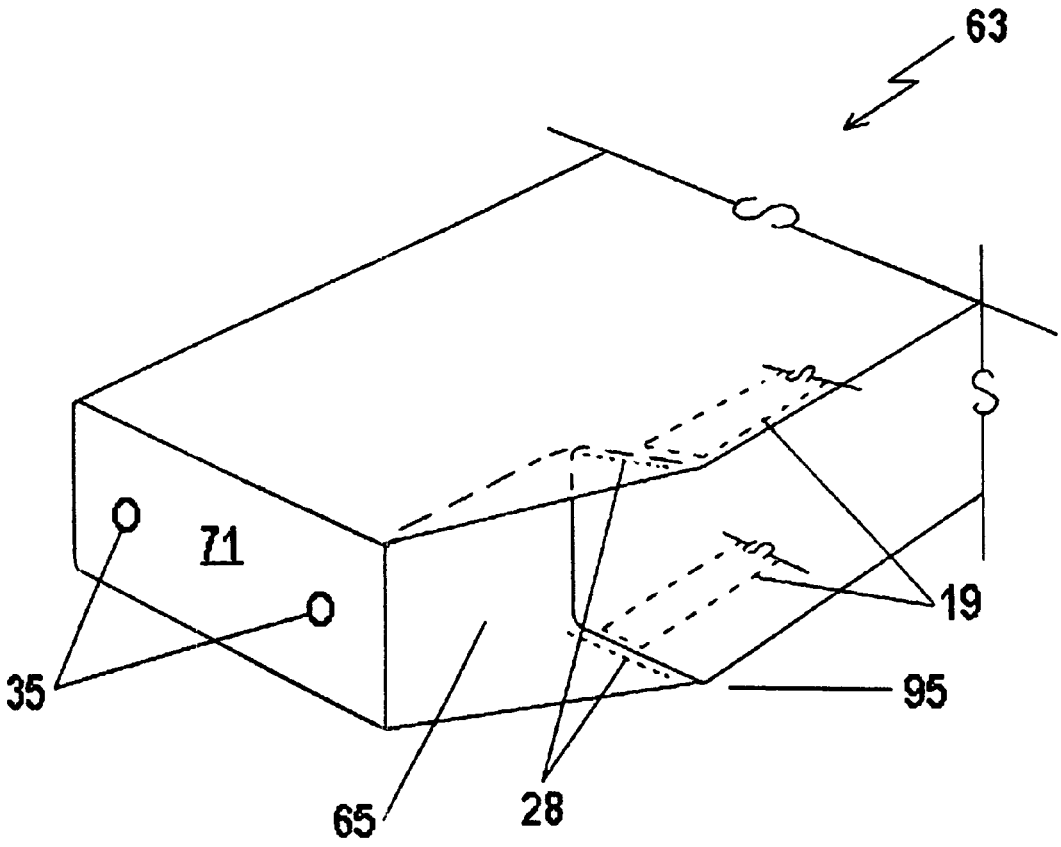
FIG. 23 is a perspective view of a tail end pocket portion of a vest-type PFD saver according to the present invention.

To ready the child-size PFD saver 85 for use, as with the larger, adult-size PFD saver, the user slides the PFD down into the top of the open PFD saver, sliding the PFD tail section 54 along opposite sides of the saver open neck 64. The end of each PFD tail section 54 is inserted into the saver tail end pocket 65, which is at the base of each saver tail portion 63 as seen in FIG. 23. The tail end pocket 65 feature is preferred for both the child and adult sized PFD savers. With the PFD 86 in place in the PFD saver 85, the saver open neck 64 lies adjacent the PFD neck 43. Each PFD neck tie strap 98 is inserted through a corresponding saver neck tie strap slot 97 (see FIG. 22). The neck tie strap can then be easily accessed from the front of the PFD/PFD saver combination. This neck tie strap step can be done before or after the threading of the PFD body strap 87 through the saver body strap slots 92.

To thread the PFD body strap 87 through the saver body strap slots 92, the free end 96 of the body strap 87 is inserted through the second body strap slot 92B, crosses the gap 72, and is laced down into the third body strap slot 92C. The free end 96 of the body strap 87 is then laced through the PFD body strap loop 89 under the PFD saver and up through the fourth body strap slot 92D (see FIG. 22). Over on the opposite end of the body strap, the first buckle portion 88A is inserted up through the first body strap slot 92A so that it is on top of the PFD saver. This body strap threading process is the same for the larger, adult-size PFD saver described herein (see FIGS. 19 and 20). The three closable body sides 66, 67 of the PFD saver are then closed by attaching corresponding hook and loop strips 19 to one another, so the top flaps 74 are closed over the bottom flaps 76 (see FIGS. 14 and 16).

To use the child's PFD saver/PFD combination, the saver tail portions 63 of the PFD/PFD saver combination are pulled apart slightly and the saver open neck 64 is placed over the child's neck with the saver tail portions 63 lying on the child's chest/stomach area. The remaining body strap 87 is placed around the child's torso and the (second) buckle portion 88B on the free end 96 of the body strap 87 is attached to the corresponding, first buckle portion 88A. The PFD neck tie straps 98 can be tied to one another. The PFD/PFD saver combination is then ready for use.

The tail end pocket 65 shown in FIG. 23 is formed by folding up the ends of the closed tail end 71 of each saver tail portion 63 and folding down the corners. The upper edges of the sides of the tail end pocket 65 are tacked down to the corresponding longitudinal side 66 of the top or bottom section 23, 22, as by sewing the side edges along seams 28 (see FIG. 23). Once one PFD tail portion 63 is inserted in each tail end pocket 65, the longitudinal sides 66 are closed by folding the top flap 74 down over the bottom flap 76 so that the hook and loop strips 19 attach to one another. The tail portions can be pulled apart from one other at the bottom, which facilitates placement of the PFD-loaded PFD saver over the user's head. The PFD saver 85 can be opened later by pulling the hook and loop strips 19 apart from one another and pulling the top section 23 of the PFD saver away from the bottom section 22 along the three body sides 66, 67. The vest-type PFD 86 can then be easily pulled out of the PFD saver 85.

From the foregoing it can be realized that the present invention may be easily and conveniently utilized as a personal flotation device saver. It is to be understood that any dimensions given herein are illustrative, and are not meant to be limiting. [0091 ] While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

20 vest-type PFD saver
17 closure mechanism
19 hook and loop strips
21 Type II PFD
22 bottom section
23 top section
24 hook and loop tabs
28 seams
29 weight strip
30 locking mechanism storage pocket
31 outside surface of main body
32 inside surface of main body
33 patch
34 conversion grab strap
35 drain holes
36 grab strap attachment site
39 main chamber
40 locking mechanism
43 PFD neck
44 hook and loop locking holes
45 locking strip
46 zipper
47 zipper pull
48 zipper pull locking holes
49 hole in zipper pull
51 grommet
54 PFD tail sections
57 flexible creases
58 end of locking strip
59 locking loop
61 main body
62 saver pillow portion
63 saver tail portions
64 saver open neck
65 saver tail end pocket
66 longitudinal sides
67 pillow end side
68 saver waist strap device
70 conversion connector device
71 closed ends of tail portions
72 gap between tail portions
74 top flap
75 conversion flotation liner
76 bottom flap
77 ends of top and bottom flaps
78 waist strap buckle portions
79 waist strap attachment site
80 waist strap loop
81 saver waist strap
82 conversion connector straps
83 conversion connector strap buckle portions
84 conversion strap attachment sites
85 vest-type slotted PFD saver
86 Type II PFD
87 PFD body strap
88 PFD buckle
89 PFD body strap loop
90 PFD body strap attachment point
91 gap between PFD tail sections
92 body strap slots
93 body strap loop attached ends
94 corner pleat
95 envelope-like lower corners
96 free end of body strap
97 saver neck tie strap slot
98 PFD neck tie strap

What is claimed is:

1. A slotted vest personal flotation device saver, comprising: (a) a saver pillow portion, and two saver tail portions extending from a same side of the saver pillow portion, the saver tail portions being substantially mirror images of one another, with at least four body strap slots on a top section of the slotted vest personal flotation device saver; (b) a central open neck extending through the slotted vest personal flotation device saver; (c) an open-ended gap extending down from the central open neck between the two saver tail portions; (d) three closable body sides, a first one of the body sides extending substantially perpendicular a second and third, substantially parallel ones of the body sides; (e) a central main chamber within the slotted vest personal flotation device saver that is accessible through the closable body sides; and (f) at least one releasable closure mechanism attached to each of the three closable body sides; wherein the slotted vest personal flotation device saver has an open position in which the releasable closure mechanisms are open, and a closed position in which the releasable closure mechanisms are closed.

2. The slotted vest personal flotation device saver according to claim 1, wherein the second and third, substantially parallel ones of the body sides form opposite, longitudinal sides of the slotted vest personal flotation device saver, the gap being substantially parallel to the longitudinal sides, which are on either side of the gap.

3. The slotted vest personal flotation device saver according to claim 2, wherein the at least four body strap slots number two on each of the saver tail portions and are substantially the same size as one another, the body strap slots being substantially parallel to one another and to the longitudinal sides of the slotted vest personal flotation device saver.

4. The slotted vest personal flotation device saver according to claim 2, wherein the releasable closure mechanisms are a plurality of hook and loop strips, and corresponding ones of the plurality of hook and loop strips on the top section and a bottom section of the slotted vest personal flotation device saver are attached to one another when the slotted vest personal flotation device saver is in the closed position, and are not attached to one another when the slotted vest personal flotation device saver is in the open position.

5. The slotted vest personal flotation device saver according to claim 1, further comprising a tail end pocket at a base end of each of the saver tail portions.

6. The slotted vest personal flotation device saver according to claim 1, further comprising two same-sized neck tie strap slots adjacent the gap on the top section of the slotted vest personal flotation device saver, with one neck tie strap slot on each of the saver tail portions, the neck tie strap slots being substantially parallel to one another and to the gap.

7. The slotted vest personal flotation device saver according to claim 2, wherein an outer end of a closed tail end of each of the saver tail portions is folded up substantially perpendicular to the closed tail end to form a tail end pocket on a bottom of each of the saver tail portions, end portions of an upper edge of the tail end pocket being tacked down to the corresponding longitudinal side of the top section or a bottom section of the slotted vest personal flotation device saver.

8. The slotted vest personal flotation device saver according to claim 2, further comprising at least two top flaps on the opposite, longitudinal sides of the top section of the slotted vest personal flotation device saver, and at least two bottom flaps on the opposite, longitudinal sides of a bottom section of the slotted vest personal flotation device saver; wherein one of the at least two top flaps is closed over a corresponding one of the at least two bottom flaps when the slotted vest personal flotation device saver is in the closed position.

9. A combination personal flotation device and vest personal flotation device saver, the vest personal flotation device saver comprising: (a) a main body comprising a saver pillow portion, two saver tail portions extending from one side of the saver pillow portion, and a central open neck that extends through the vest personal flotation device saver, a gap extending down from the central open neck between the two saver tail portions, and three closable sides of the main body;

(b) a releasable closure mechanism on each of the three closable sides of the main body;

(c) a releasable saver waist strap device, a portion of which is attached to the saver tail portion; (d) a conversion system comprising (1) a releasable conversion connector device attached to a closed end of each of the saver tail portions, (2) at least two conversion grab straps attached to the main body, and (3) a conversion flotation liner that comprises a plurality of floatable conversion flotation liner sections; and (e) a locking mechanism on the main body, the locking mechanism being adjacent the releasable closure mechanism; wherein the main body has an open position in which the releasable closure mechanism is open, and a closed position in which the releasable closure mechanism is closed.

10. The combination according to claim 9, wherein the conversion connector device comprises at least one conversion connector strap and a corresponding conversion connector strap buckle in a normally closed position.

11. The combination according to claim 9, wherein the conversion connector device comprises at least one conversion connector strap and a corresponding conversion connector strap buckle in an unsnapped position.

12. The combination according to claim 9, wherein the locking mechanism comprises a set of locking holes on at least two sides of the vest personal flotation device saver, and a locking strip that extends through each set of locking holes.

13. The combination according to claim 9, wherein the releasable closure mechanism is at least one zipper, the main body further comprising an accessible locking mechanism storage pocket.

14. The combination according to claim 9, further comprising:

a closed tail end pocket at an end of each of the saver tail portions, a weight strip attached in each tail end pocket of each of the saver tail portions, and at least two drain holes in each tail end pocket.

15. A vest personal flotation device saver, comprising: (a) a main body comprising: (1) a saver pillow portion, (2) two saver tail portions extending from a same side of the saver pillow portion, and (3) a central open neck, (4) a gap extending down from the central open neck between the two saver tail portions, (5) a closed tail end pocket at the end of each of the saver tail portions, and (6) three closable sides of the main body; (b) a releasable closure mechanism on each of the three closable sides of the main body; (c) a releasable saver waist strap device, a portion of which is attached to the saver tail portion; and (d) a locking mechanism on the main body adjacent the releasable closure mechanism;

wherein the main body has an open position in which the releasable closure mechanism is open, and a closed position in which the releasable closure mechanism is closed.

16. The vest personal flotation device saver according to claim 15, further comprising: (e) a releasable conversion connector device attached to a closed end of each of the saver tail portions; (f) at least two conversion grab straps, each having opposite ends attached to the main body; and (g) a conversion flotation liner that comprises a plurality of floatable conversion flotation liner sections within the vest personal flotation device saver.

17. The vest personal flotation device saver according to claim 15, wherein the releasable closure mechanism comprises a plurality of hook and loop strips, a first portion of the hook and loop strips being attached along an edge of a top section of the main body, a second, corresponding portion of the hook and loop strips being attached along an edge of a bottom section of the main body; corresponding portions of the hook and loop strips being removably attached to one another when the vest personal flotation device saver is in the closed position.

18. The vest personal flotation device saver according to claim 15, wherein the releasable closure mechanism is at least one zipper, the locking mechanism comprising at least one locking strip; the at least one zipper being closed and locked by the at least one locking strip.

19. The vest personal flotation device saver according to claim 15, wherein at least one top flap of the vest personal flotation device saver is closed over a corresponding bottom flap of the vest personal flotation device saver when the vest personal flotation device saver is in the closed position.

20. The vest personal flotation device saver according to claim 15, wherein the saver pillow portion comprises at least one seam that forms at least two boxed corners on the saver pillow portion.

* * * * *